US006331130B1

(12) United States Patent
Thai

(10) Patent No.: US 6,331,130 B1
(45) Date of Patent: Dec. 18, 2001

(54) BUBBLE GENERATING ASSEMBLIES

(76) Inventor: Douglas Thai, 19907 Tennessee Trail, Walnut, CA (US) 91789

( * ) Notice: Subject to any disclaimer, the term of this patent is extended or adjusted under 35 U.S.C. 154(b) by 0 days.

(21) Appl. No.: 09/476,864

(22) Filed: Jan. 3, 2000

(51) Int. Cl.[7] ..... A63H 33/00
(52) U.S. Cl. ..... 446/15; 446/16
(58) Field of Search ..... 446/15, 16, 17, 446/20, 21; 40/409

(56) References Cited

U.S. PATENT DOCUMENTS

| | | | | |
|---|---|---|---|---|
| 2,560,582 | | 7/1951 | Limber . | |
| 2,659,177 | | 11/1953 | Kopf . | |
| 2,700,845 | | 2/1955 | Arliss . | |
| 2,974,438 | * | 3/1961 | Hopkins | 446/16 |
| 3,100,947 | * | 8/1963 | Hellman | 446/15 |
| 3,604,144 | * | 9/1971 | Span | 446/15 |
| 3,913,260 | * | 10/1975 | Corbett | 446/16 |
| 4,700,965 | * | 10/1987 | Kinberg | 446/16 |
| 4,957,464 | * | 9/1990 | Perez | 446/15 |
| 5,234,129 | | 8/1993 | Lau . | |
| 5,395,274 | * | 3/1995 | Myers | 446/16 |
| 5,462,469 | | 10/1995 | Lei . | |
| 5,498,191 | | 3/1996 | DeMars . | |
| 5,542,869 | * | 8/1996 | Petty | 446/16 |
| 5,613,890 | * | 3/1997 | DeMars | 446/15 |
| 5,746,636 | * | 5/1998 | Cernansky et al. | 446/16 |
| 5,879,218 | * | 3/1999 | Tao | 446/15 |
| 6,062,935 | * | 5/2000 | Gross | 446/15 |

* cited by examiner

*Primary Examiner*—Sam Rimell
(74) *Attorney, Agent, or Firm*—Raymond Sun

(57) ABSTRACT

A bubble generating assembly has an air generator, and a bubble producing device positioned in front of the air generator to receive air generated from the air generator. The assembly also has a liquid generator, a nozzle coupled to the liquid generator for ejecting liquid from the assembly, and an actuator operatively coupled to the liquid generator and the air generator for simultaneously actuating the liquid generator and the air generator. Another bubble generating assembly has an air generator, a plurality of bubble producing wands, a link having a first end coupled to the bubble producing wands, and an actuator operatively coupled to the link assembly and the air generator for simultaneously actuating the air generator and causing the link to position all the wands in front of the air generator to receive air generated from the air generator.

21 Claims, 11 Drawing Sheets

BUBBLE GENERATING ASSEMBLIES

BACKGROUND OF THE INVENTION

1. Field of the Invention

The present invention relates to bubble generating assemblies, and in particular, to bubble generating assemblies where a single action can be used to actuate two or more different functions within a bubble generating assembly.

2. Description of the Prior Art

Bubble producing toys are very popular among children who enjoy producing bubbles of different shapes and sizes. Many bubble producing toys have previously been provided. Perhaps the simplest example has a stick with a circular opening or port at one end, resembling a wand. A film is produced when the port is dipped into a bubble solution or bubble producing fluid (such as soap) and then removed therefrom. Bubbles are then formed by blowing carefully against the film. Such a toy requires dipping every time a bubble is to created, and the bubble solution must accompany the wand from one location to another. Another drawback is that only one bubble can be produced at a time. Therefore, such simple bubble producing toys offer limited amusement and are limited in the types, shapes and sizes of the bubbles that they can produce.

As a result, attempts have been made to provide bubble producing toys that offer more variety and amusement. Many of these newer bubble producing toys are more sophisticated, and many even allow for the provision of multiple bubbles.

Notwithstanding such recent attempts, the bubble producing process utilized by each of these bubble producing toys requires multiple steps. In a first step, the wand(s) must be dipped into a bubble solution. In a second step, air is blown at the wand(s) to produce the bubble(s). In a third optional step, the user may choose to pierce or burst the produced bubble(s). Thus, two or three steps are required, thereby rendering the play or use of these bubble producing toys to be tedious and troublesome. To make matters worse, if the dipping (i.e., the first step) is not done properly, bubbles cannot be formed in the second step.

Thus, there remains a need to provide a bubble producing device that can enhance the amusement value and play variety for children.

SUMMARY OF THE DISCLOSURE

It is an object of the present invention to provide a bubble generating device that enhances the amusement value and play variety for children.

It is another object of the present invention to provide a bubble generating device that reduces the number of steps required to produce bubbles.

It is another object of the present invention to provide a bubble generating device where a single action can be used to actuate two or more functions.

It is yet another object of the present invention to provide a bubble generating device where a single action can be used to produce one or more bubbles.

It is a further object of the present invention to provide a bubble generating device where a single action can be used to produce bubbles and to fire water at the produced bubbles.

The objectives of the present invention are accomplished by providing, in one embodiment, a bubble generating assembly that has an air generator, and a bubble producing device positioned in front of the air generator to receive air generated from the air generator. The assembly also has a liquid generator, a nozzle coupled to the liquid generator for ejecting liquid from the assembly, and an actuator operatively coupled to the liquid generator and the air generator for simultaneously actuating the liquid generator and the air generator.

The present invention also provides, according to another embodiment, a bubble generating assembly having an air generator, a plurality of bubble producing wands, a link having a first end coupled to the bubble producing wands, and an actuator operatively coupled to the link assembly and the air generator for simultaneously actuating the air generator and causing the link to position all the wands in front of the air generator to receive air generated from the air generator.

DETAILED DESCRIPTION OF THE PREFERRED EMBODIMENTS

Figure 1:
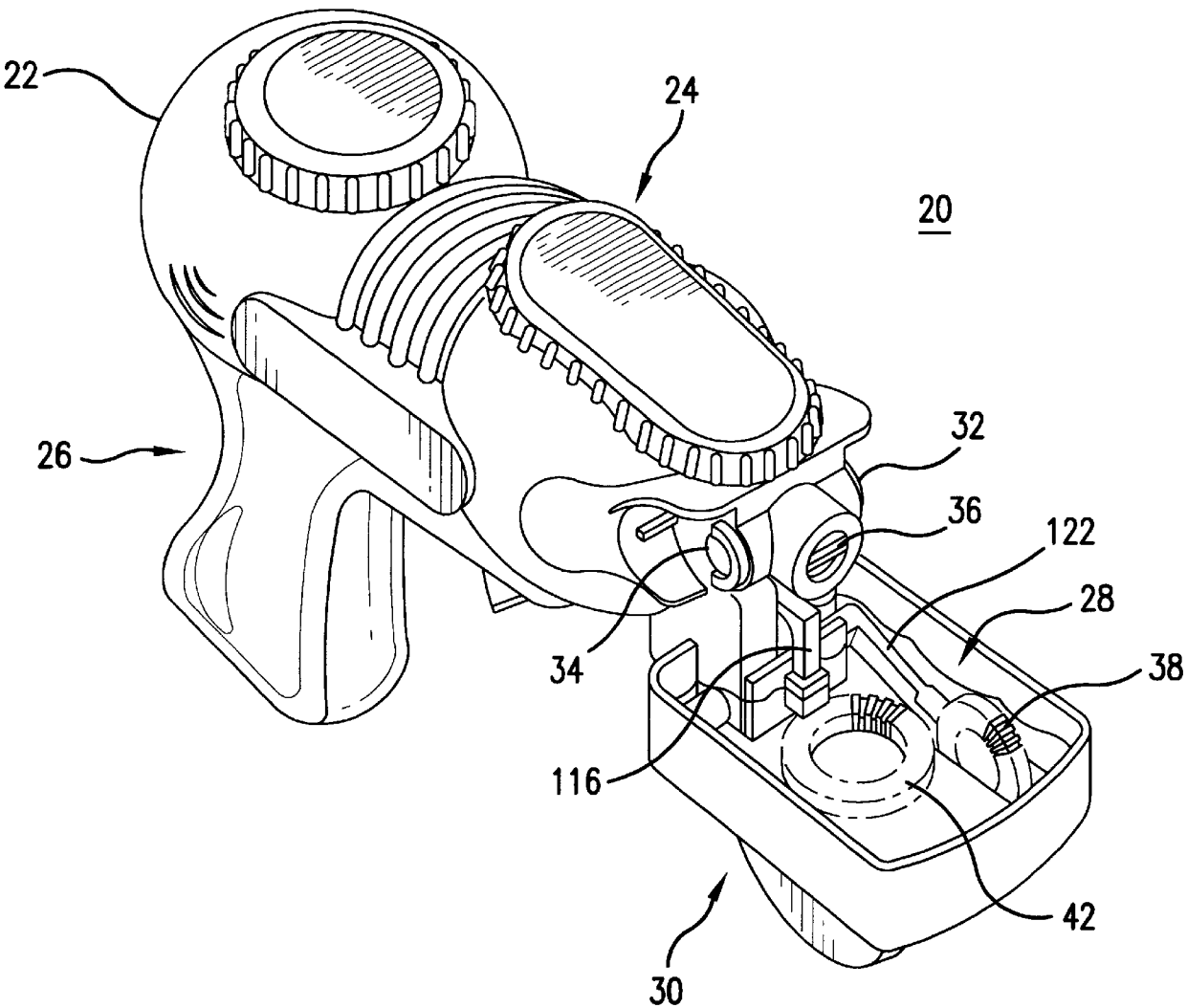
FIG. 1 is a top perspective view of a bubble generating assembly according to one embodiment of the present invention shown in the non-use position.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides bubble generating assemblies that reduce the number of steps required to produce bubbles by using a single action to actuate or perform two or more different functions within the assembly. As a result, the bubble generating assemblies can generate bubbles more easily and quickly, while enhancing the amusement value to the user.

FIGS. 1–4 illustrate a bubble generating assembly 20 according to one embodiment of the present invention. The assembly 20 can be embodied in the form of a bubble producing gun, and has a housing 22 that includes a barrel section 24 and a handle section 26. A bubble producing device 28 and an associated solution container 30 are provided at the front end of the barrel section 24 adjacent the nozzles 32, 34, 36 of the barrel section 24. The three nozzles 32, 34, 36 can be positioned so that nozzles 32 and 34 open to opposing sides of the assembly 20, and nozzle 36 opens towards the front of the assembly 20 so that the front nozzle 36 is generally perpendicular to the side nozzles 32 and 34. The bubble producing device 28 can include three wands or loops 38, 40, 42 that include two side wands 38 and 40 and a front wand 42. Each wand 38, 40 and 42 is operatively coupled (as described hereinbelow) to the barrel section 24 and can be raised from a rest or non-use position inside the solution container 30 to a bubble generating position adjacent a corresponding nozzle 32, 34 and 36, respectively.

Figure 5:
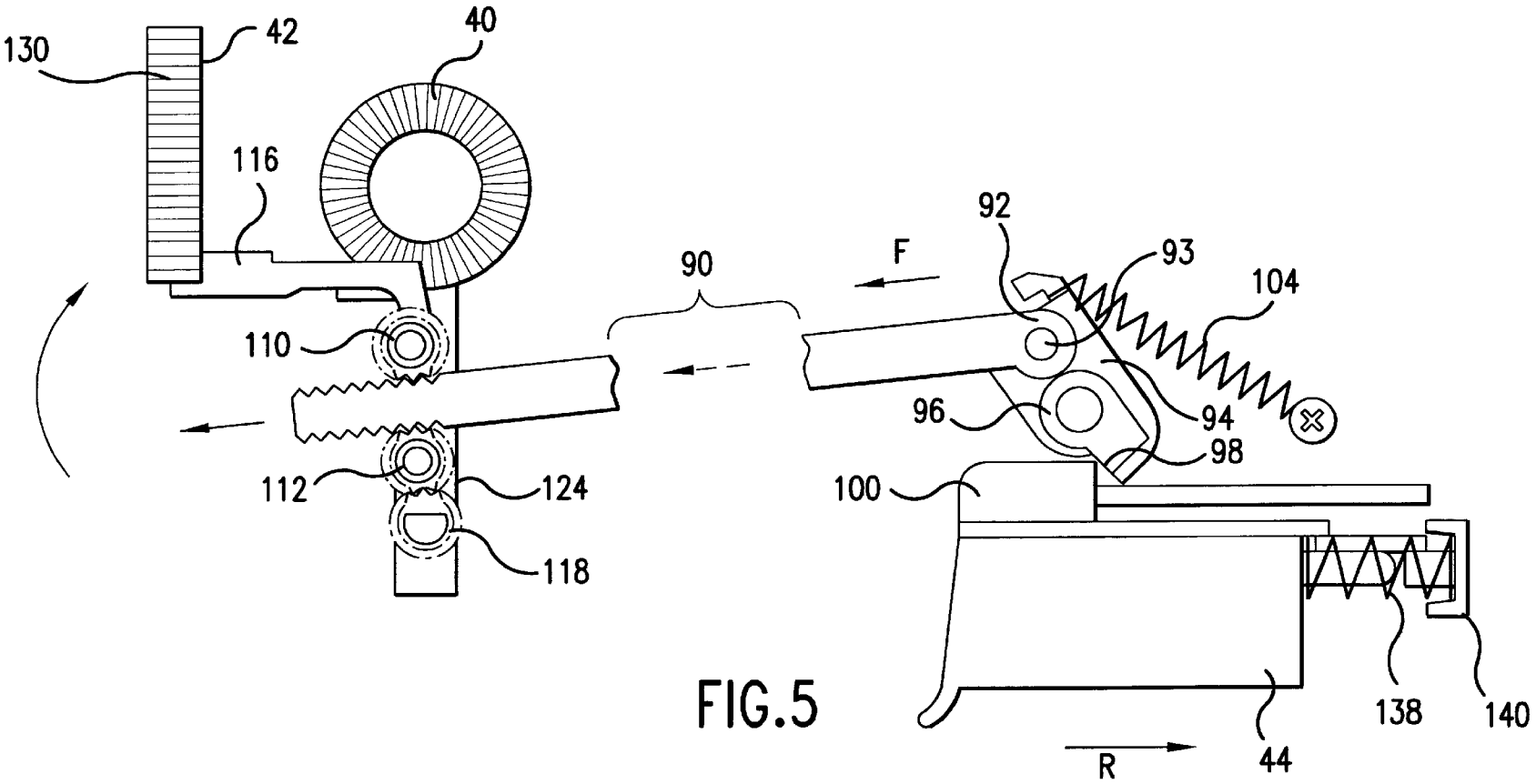
FIG. 5 illustrates how the trigger actuates the link assembly to raise the bubble producing devices in the bubble generating assembly of FIG. 1.
Figure 6:
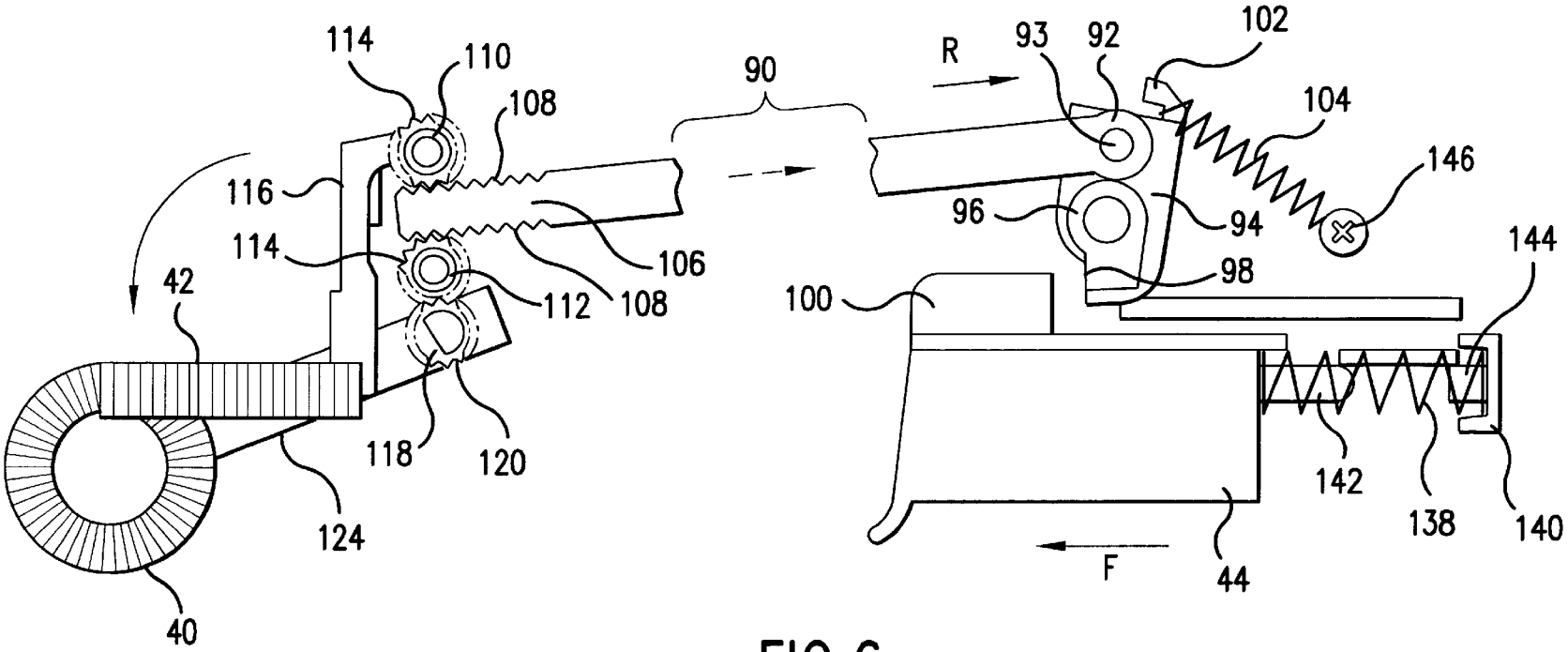
FIG. 6 illustrates how release of the trigger actuates the link assembly to lower the bubble producing devices in the bubble generating assembly of FIG. 1.
Figure 7:
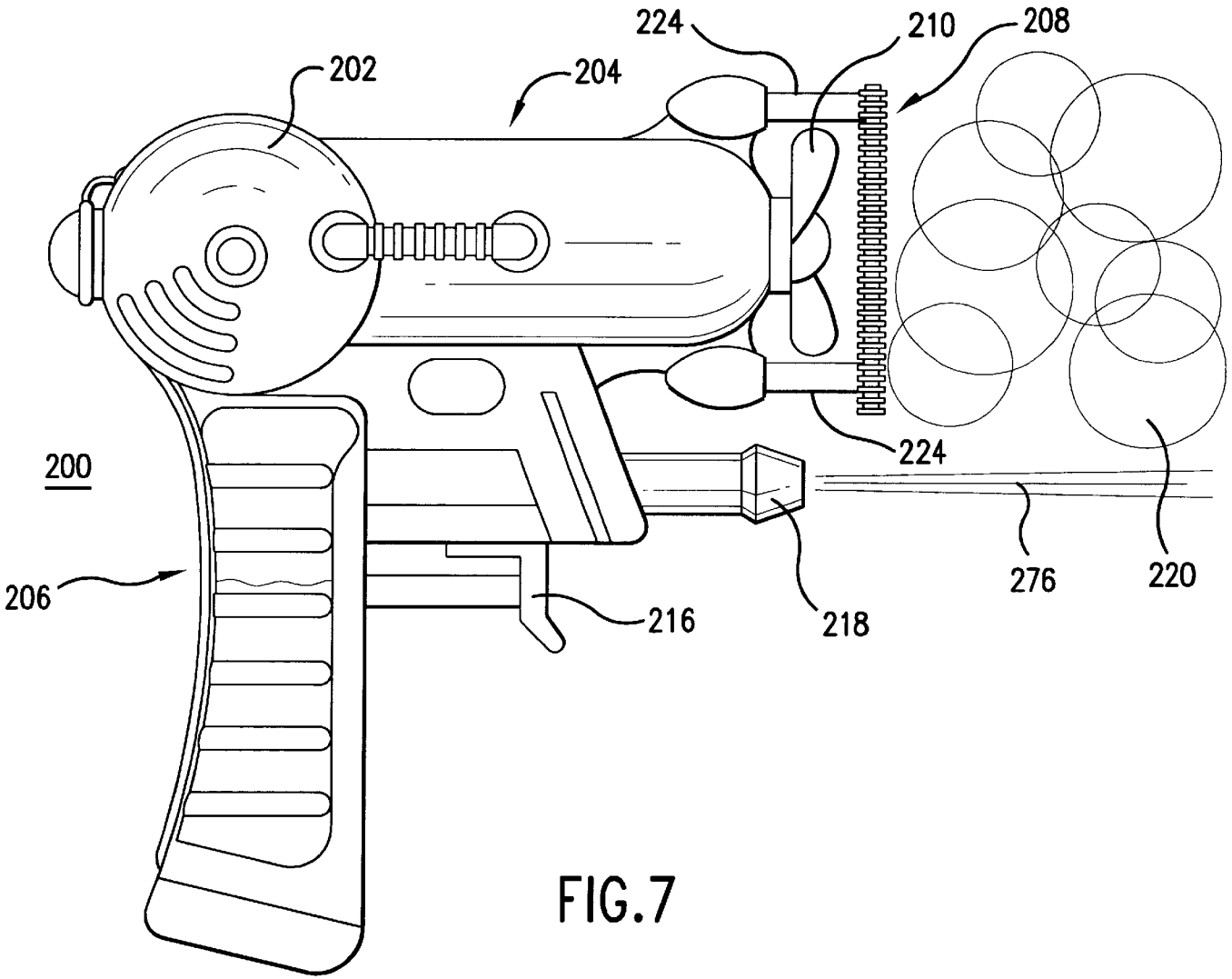
FIG. 7 is a side view of a bubble generating assembly according to another embodiment of the present invention.
Figure 8:
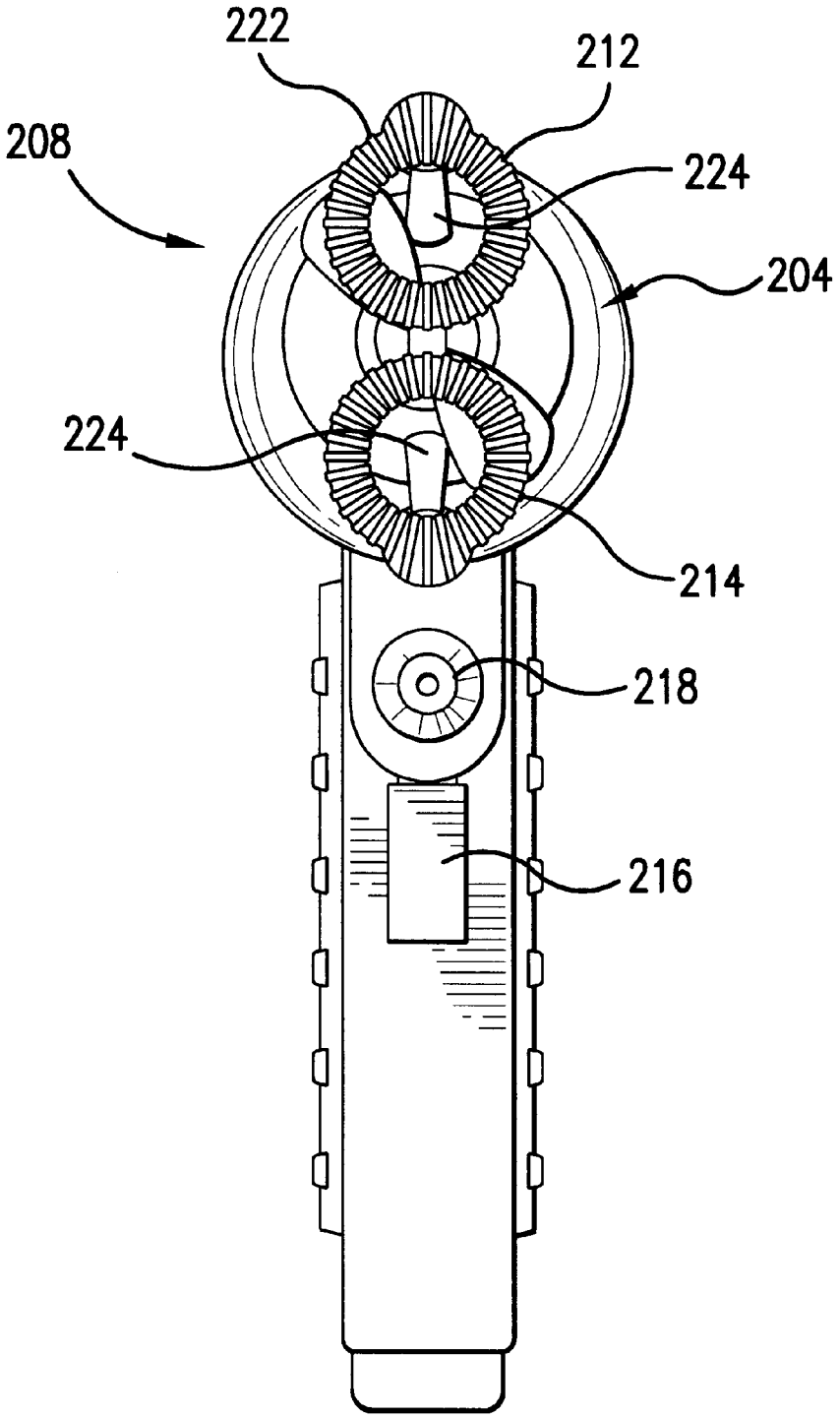
FIG. 8 is a front view of the bubble generating assembly of FIG. 7.

A trigger 44 is operatively coupled to the barrel section 24 and handle 26 to actuate the assembly 20. Referring also to FIGS. 5 and 6, a spring 138 has a rear end that is seated on a shaft 144 in a slot 140 in the handle section 26, and has an opposing front end that is carried by a shaft 142 on the trigger 44 that abuts the rear end of the trigger 44 to naturally bias the trigger 44 in a forward direction (see arrow F) towards the nozzles 32, 34, 36. In particular, the assembly 20 is shown in a non-use position in FIG. 1, while in FIG. 2, the assembly 20 can be actuated by pressing the trigger 44 to simultaneously (1) raise the wands 38, 40 and 42 to a bubble generating position and (2) cause air to be blown through the nozzles 32, 34, 36 and through the wands 38, 40, 42 to produce three separate streams of bubbles 46.

The housing 22 can be provided in the form of two symmetrical outer shells that are connected together by, for example, screws 48 or by welding or glue. These outer shells together define a hollow interior for housing the internal components of the assembly 20, as described below.

Referring now to FIGS. 3–6, the handle section 26 houses a power source 52 which can include two conventional batteries. The barrel 24 houses an air generator or blower 54 that is driven by a motor 56 that is electrically coupled to the power source 52 via a wire 58. The barrel 24 also houses a link assembly 60 that functions to raise and lower the wands 38, 40, 42. The trigger 44 extends through an opening 62 in the housing 22 and is mechanically coupled to the link assembly 60, and electrically coupled to both the power source 52 (by opposing electrical conductors 64 and 66) and the motor 56 (by wiring 68).

Figure 3:
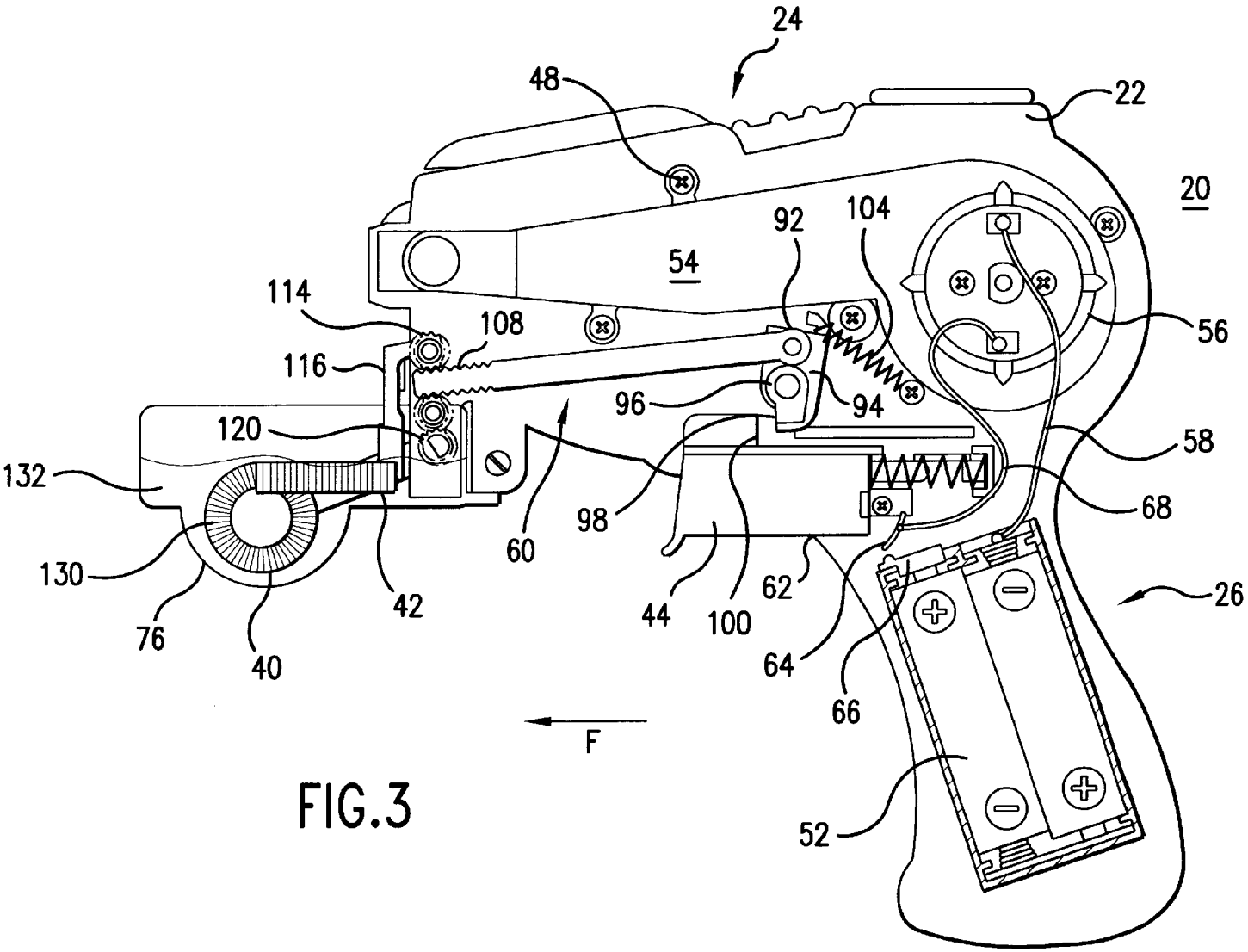
FIG. 3 is a cross-sectional side view of the bubble generating assembly of FIG. 1.
Figure 4:
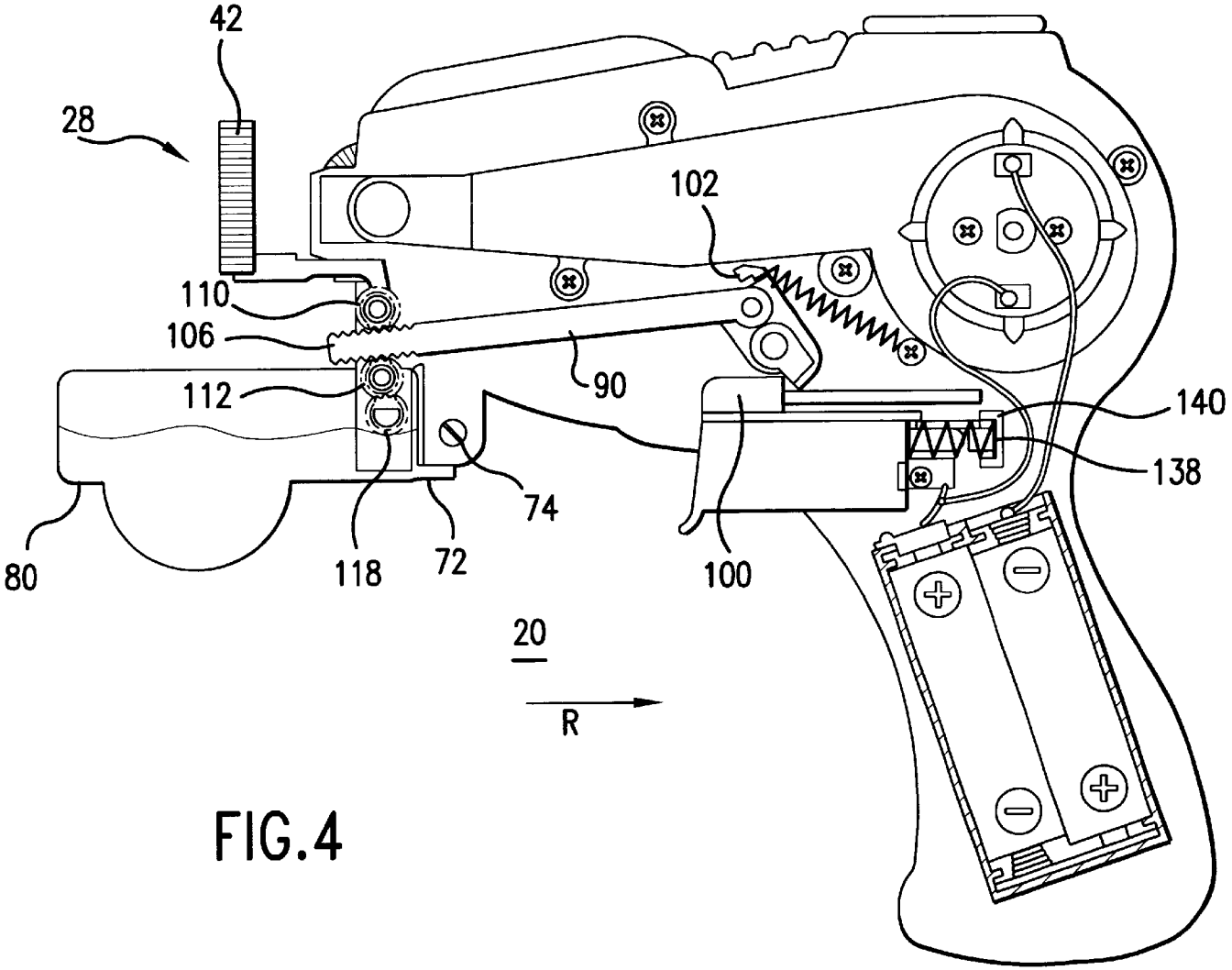
FIG. 4 is a cross-sectional side view of the bubble generating assembly of FIG. 2.

The solution container 30 has an inner end 72 connected to the front of the barrel section 24 by either welding, screws (e.g., 74 as shown in FIGS. 3 and 4), or the like. The solution container 30 can be shaped as a dish having two narrow semi-circular troughs 76 and 78 extending from the base 80 of the container 30. Each trough 76, 78 is adapted to receive a portion of a side wand 40 and 38, respectively, in the non-use position, so that the entire circumference of each side wand 38 and 40 can be immersed in the bubble solution. This enables the container 30 to be provided with lower side walls 82 and 84, thereby minimizing the height profile of the container 30 and the bulkiness of the overall assembly 20.

The link assembly 60 operates to mechanically couple the trigger 44 to the wands 38, 40, 42 to control the raising and lowering of the wands 38, 40, 42. The link assembly 60 has a rod 90 having an enlarged and rounded first end 92 that operates as a cam surface. The first end 92 is pivotably coupled to a block 94 (i.e., coupled to allow first end 92 and block 94 to pivot separately). A generally rounded cam piece 96 is permanently coupled to the block 94 (i.e., coupled so that cam piece 96 and block 94 cannot pivot separately). The first end 92 and the cam piece 96 are disposed in a manner in which the circumferential surface of the cam piece 96 rotatably engages the circumferential surface of the first end 92. The cam piece 96 has a straight engaging surface 98 that is adapted to be engaged by a block 100 provided on the trigger 44. The block 94 has a hooked extension 102 on which one end of a spring 104 is coupled. The other end of the spring 104 is secured to the housing 22 (e.g., by screw 146).

The rod 90 has a serrated second end 106 having a plurality of teeth 108 on its top and bottom sides that are adapted to engage a gearing system that operates to raise and lower the wands 38, 40, 42. The gearing system includes gears that are coupled to each of the wands 38, 40, 42. For example, a pair of opposing first and second gears 110 and 112 have teeth 114 that are engaged to travel along the teeth 108 of the opposing top and bottom sides of the rod 90. The gear 110 is housed inside the housing 22, and is connected to one end of a generally L-shaped rod 116 which extends outside the housing 22 and whose opposite end is connected to the front wand 42 (see also FIGS. 1 and 2) in a manner such that the rod 116 is generally perpendicular to the front wand 42. A third gear 118 has teeth 120 that are adapted to engage the teeth 114 of the second gear 112. The third gear 118 is also housed inside the housing 22. The first and second gears 110, 112 can be provided in the form of two toothed wheels, while the third gear 118 can be an elongated circular rod having teeth 120 provided on its outer annular surface. The elongated nature of the third gear 118 allows each of its opposing ends to be connected to one end of a rod 122 and 124 which extends outside the housing 22 and whose opposite end is connected to one of the side wands 38 and 40, respectively (see also FIGS. 1 and 2). Each rod 122, 124 is generally parallel to or co-planar with its corresponding side wand 38, 40, respectively. Thus, the third gear 118 alone can be used to control the two side wands 38 and 40.

Each wand 38, 40, 42 can have the same structure, and in one non-limiting embodiment, can be a ring-like loop that has an opening, and with ridges or bumps 130 provided on the outer surfaces of the rings. The ridges 130 function to hold the bubble solution against the ring to form a solution film that is blown to form the bubble. The front wand 42 can be larger than the two side wands 38, 40.

The operation of the assembly 20 is illustrated in connection with FIGS. 1–6. First, the container 30 is filled with bubble solution 132. At this time (shown in FIGS. 1 and 3), the wands 38, 40, 42 are positioned inside the container 30, and preferably completely inside the solution 132. The side wands 38, 40 are positioned perpendicular to the front wand 42, with the side wands 38, 40 being generally vertical with respect to the orientation of the assembly 20 and partially positioned inside the troughs 76, 78, and with the front wand 42 being generally horizontal with respect to the orientation of the assembly 20 and positioned between the side wands 38, 40.

Figure 2:
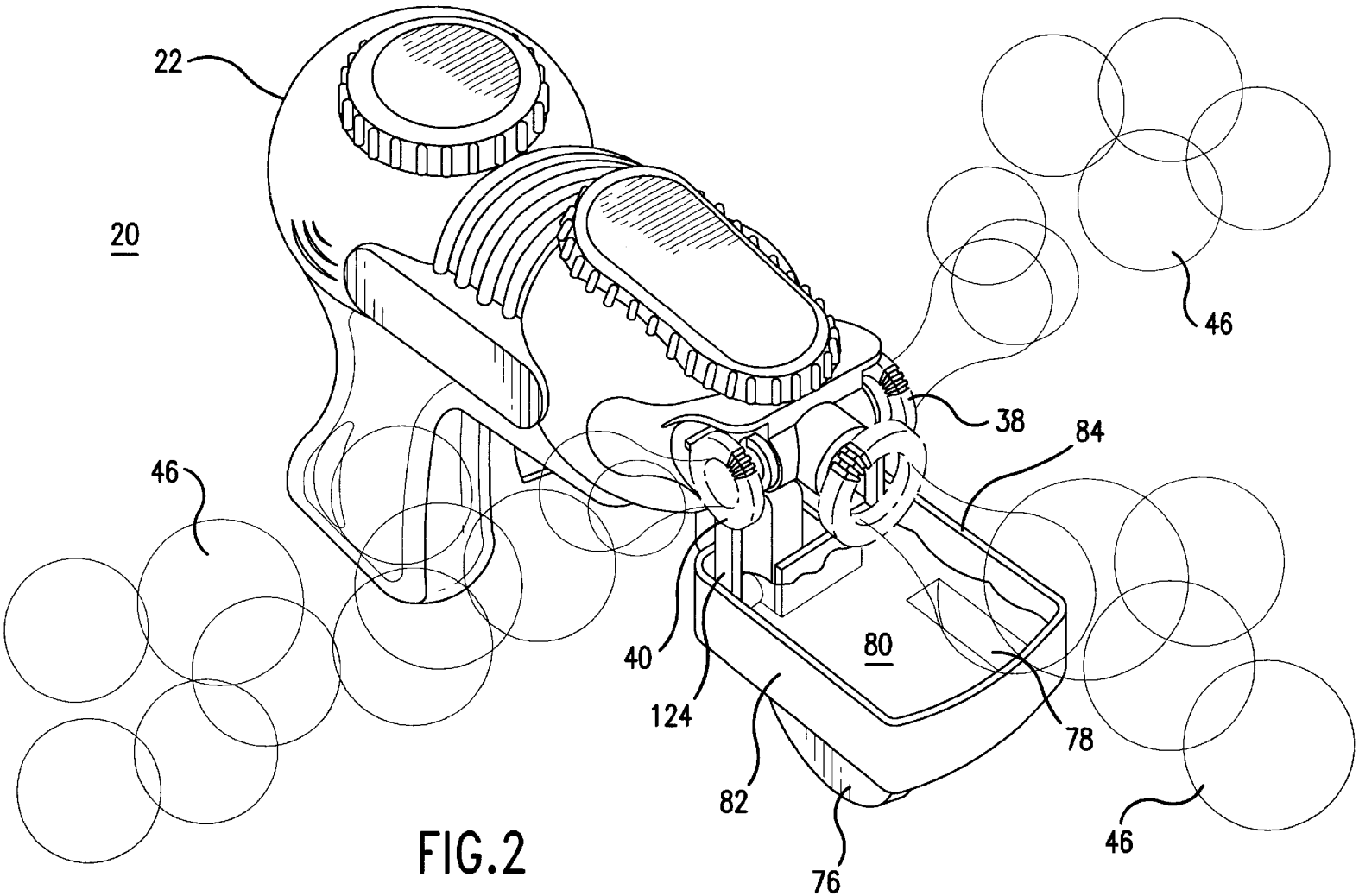
FIG. 2 is a top perspective view of the bubble generating assembly of FIG. 1 shown in the bubble generating position.

In the next step, the user presses the trigger 44 to cause the trigger 44 to move rearwardly in the direction of arrow R. As shown in FIG. 4, the electrical conductor 64 on the trigger 44 will engage the electrical conductor 66 of the power source 52, causing the motor 56 to be powered to generate bursts of air that are then emitted from the blower 54 through the three nozzles 32, 34, 36. Simultaneously, the block 100 positioned on the top of the trigger 44 engages the engaging surface 98 of the cam piece 96, and pushes the cam piece 96 rearwardly in the direction of arrow R (see FIG. 5). This causes the block 94 and the first end 92 to be pivoted about their pivot point 93, which in turn causes the lower part of the block 94 (where the cam piece 96 is positioned) to be moved rearwardly, and the upper part of the block 94 (where the first end 92 is positioned) to be moved forwardly (see arrow F). The forward motion of the first end 92 will stretch the spring 104 to build up a spring load, and will cause the entire rod 90 to be moved forwardly, causing the serrated front end 106 to pass between the gears 110 and 112. The teeth 108 on the rod 90 will engage the teeth 114 of the gears 110, 112 and will travel thereon, causing the first gear 110 to rotate in the clockwise direction (as seen in the orientation of FIGS. 3 and 4), and the second gear 112 to rotate in the counter-clockwise direction, thereby causing the front wand 42 to be raised. The counter-clockwise rotation of the second gear 112 will simultaneously cause the third gear 118 to rotate in a clockwise manner thereby causing the side wands 38, 40 to be raised. Thus, the three wands 38, 40, 42 are raised at about the same time, and when raised, each will be adjacent a nozzle 32, 34 and 36, respectfully. Therefore, the air that is blown from the blower 54 through the nozzles 32, 34, 36 will pass through the wands 38, 40, 42, producing three separate streams of bubbles 46, as shown in FIG. 2.

After the three streams of bubbles 46 have been produced, and upon relaxing the force applied to the trigger 44, two events will occur simultaneously: (1) the spring 138 coupled to the rear of the trigger 44 will bias the trigger 44 forwardly (see arrow F in FIG. 6) so as to disengage the contact between the electrical conductors 64 and 66, cutting power to the motor 56, and (2) the built-up spring load of the spring 104 will bias the upper part of the block 94 rearwardly, pulling the rod 90 rearwardly (see arrow R in FIG. 6) and causing the gears 110, 112, 118 to rotate in directions opposite to those described above (i.e., counter-clockwise for gears 110, 118, and clockwise for gear 112) to lower the wands 38, 40, 42 back into their non-use positions inside the container 30 as shown in FIGS. 1 and 3. At this time, the assembly 20 is again ready to produce bubbles 46 upon the pressing of the trigger 44.

Thus, the embodiment illustrated in FIGS. 1–4 simultaneously performs two functions when actuated: (1) to prepare and position wands 38, 40, 42 that are covered by a film of bubble solution, and (2) to generate air to be blown through the wands 38, 40, 42. The simultaneous performance of these two functions allows bubbles to be produced by simply actuating a trigger 44. In addition, the mere release of the trigger 44 will allow the assembly 20 to re-position itself to the non-use position where it is immediately ready to generate additional bubbles. As a result, the use and operation of the assembly 20 is fast and simple.

FIGS. 7–12 illustrate a bubble generating assembly 200 according to another embodiment of the present invention. The assembly 200 can also be embodied in the form of a bubble producing gun, and has a housing 202 that includes a barrel section 204 and a handle section 206. A bubble producing device 208 and an associated air generator (such as a fan) 210 are provided at the front end of the barrel section 204. The bubble producing device 208 can include a plurality of wands or loops 212 and 214 (as described in greater detail below). A water generator is coupled to a nozzle 218 that is provided at the front end of the barrel section 204, below the bubble producing device 208. A trigger 216 is operatively coupled to the barrel section 204 and handle 206 to actuate the assembly 20. In particular, the assembly 200 can be actuated by pressing the trigger 216, which will simultaneously (1) actuate the fan 210 to generate air that will be blown at the wands 212 and 214 to produce bubbles 220, and (2) cause water to be ejected from the nozzle 218 to be fired at the produced bubbles 220.

The housing 202 can be provided in the form of two symmetrical outer shells that are connected together by, for example, screws or welding or glue. These outer shells together define a hollow interior for housing the internal components of the assembly 200, as described below.

Each wand 212 and 214 can have the same structure, and in one non-limiting embodiment, can be a ring-like loop having ridges or bumps 222 provided on the outer surface of each ring. The ridges 222 function to hold the bubble solution against the ring to form a solution film that is blown to form the bubble. A plurality of support legs 224 extend from the front of the barrel section 204 of the housing 202 and are connected to the wands 212, 214. The wands 212, 214 are positioned in a plane that is perpendicular to the direction from which the air is directed from the fan 210. The wands 212, 214 can be provided in the same plane.

Figure 9:
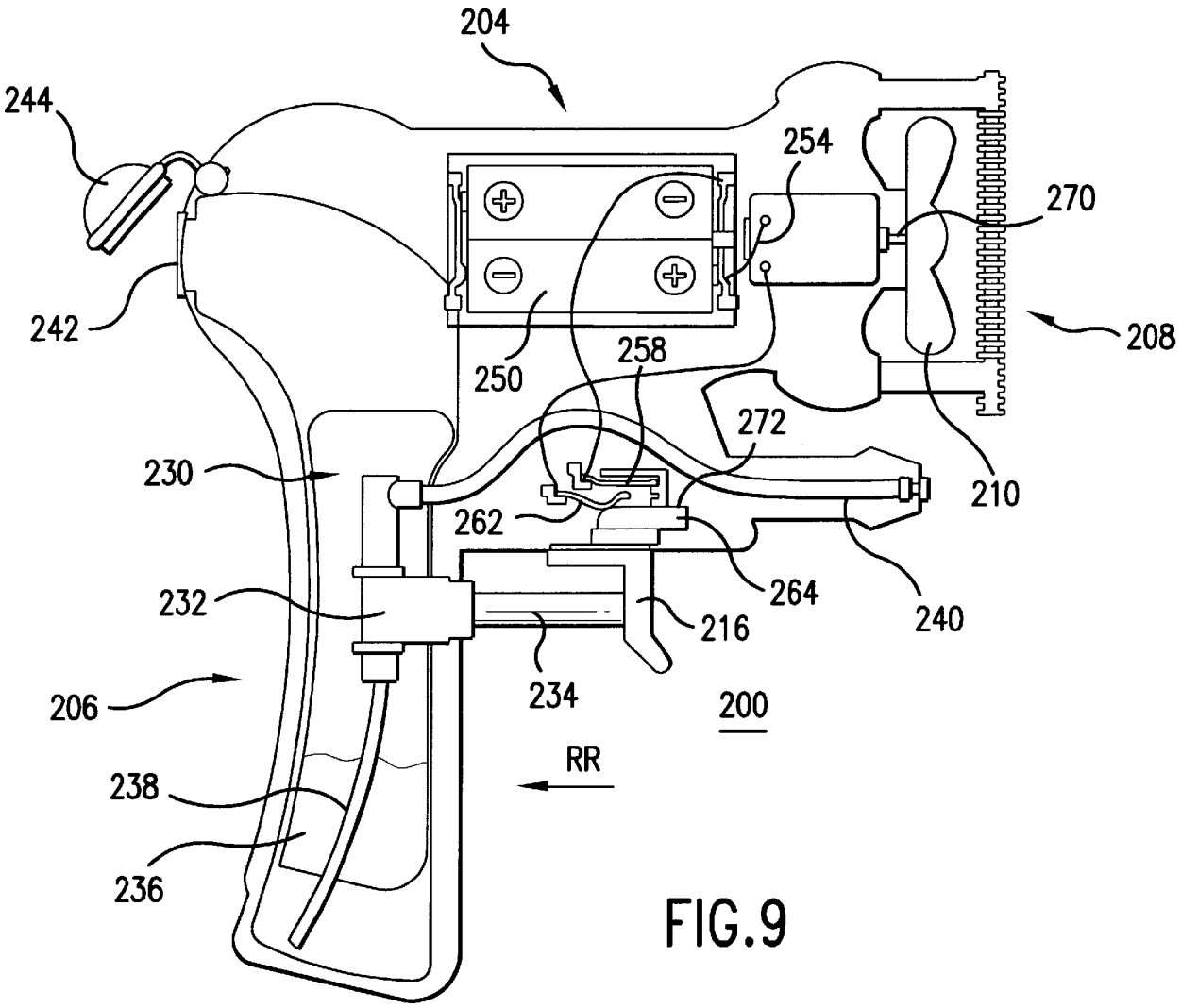
FIG. 9 is a cross-sectional side view of the bubble generating assembly of FIG. 7 in the non-use position.
Figure 10:
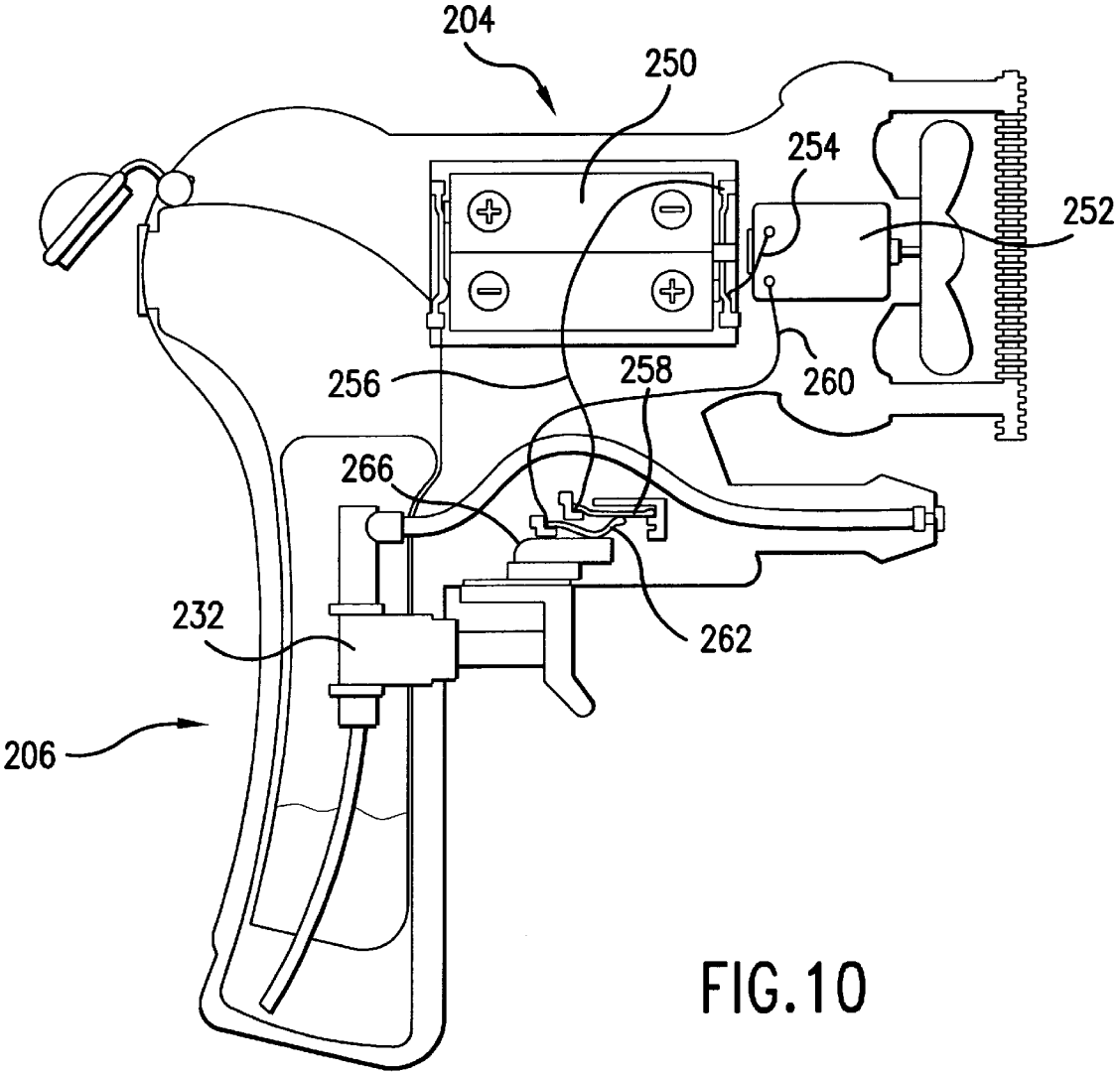
FIG. 10 is a cross-sectional side view of the bubble generating assembly of FIG. 7 in the bubble generating position.

The water generator is illustrated in FIGS. 9 and 10, and includes a water reservoir 230 and a pump 232 (described in greater detail below) that are housed in the handle section 206. The pump 232 has a piston 234 coupled to the trigger 216, and a first tubing 238 extending into the reservoir 230 for drawing water 236 into the pump 232. The pump 232 further includes a second tubing 240 that extends through the barrel section 204 and is coupled to the nozzle 218. An opening 242 is provided in the housing 202 for fluid communication with the reservoir 230. Water can be introduced through the opening 242, and then a stopper 244 plugged into the opening 242 to is seal it.

The barrel section 204 houses a power source 250 which can include two conventional batteries. The barrel section 204 also houses a motor 252 that is electrically coupled to the power source 250 via a wiring system that forms a circuit for actuating the motor 252. The wiring system includes a first wire 254 that couples the power source 250 to the motor 252, a second wire 256 that couples the power source 250 to a first electrical contact 258, and a third wire 260 that couples the motor 252 to a second generally V-shaped electrical contact 262 that is normally spaced apart from the first electrical contact 258 (see FIG. 9). As shown in FIG. 9, the second electrical contact 262 rests on a ramped rear edge 266 of a block 264 that is carried on the top of the trigger 216. The fan 210 has a shaft 270 that is coupled to the motor 252, so that actuation of the motor 252 will cause the shaft 270 to rotate, thereby causing the blades of the fan 210 to rotate.

Figure 11:
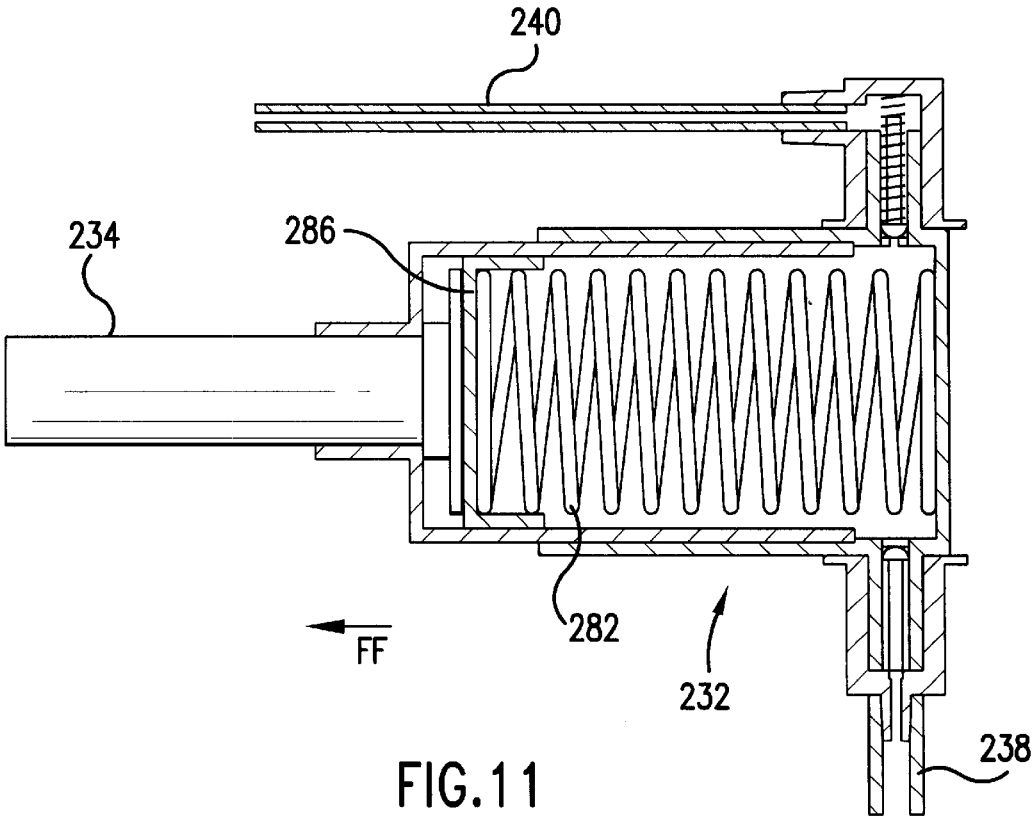
FIG. 11 illustrates the trigger and pump of the bubble generating assembly of FIG. 7 in the non-use position.
Figure 12:
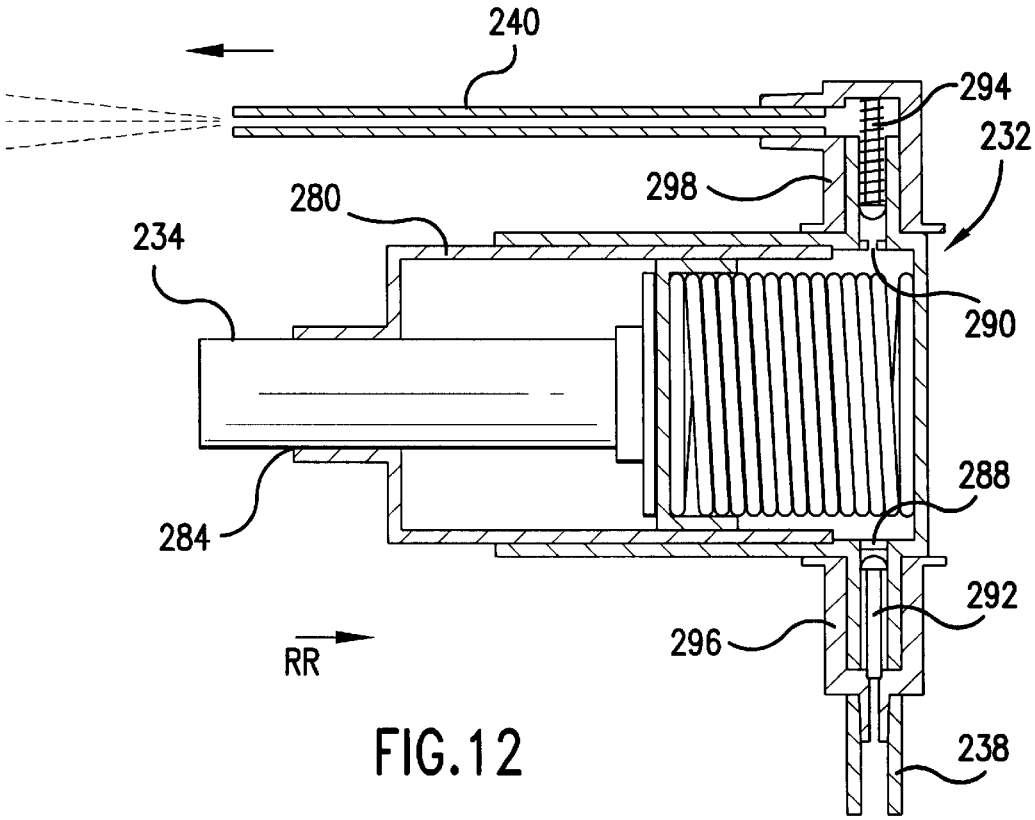
FIG. 12 illustrates the trigger and pump of the bubble generating assembly of FIG. 7 in the bubble generating position.

As shown in FIGS. 11 and 12, the pump 232 has a pump chamber 280 inside which is retained a spring 282. The piston 234 extends through an opening 284 in the chamber 280 and has a pusher surface 286 that is positioned adjacent one end of the spring 282. The chamber 280 also has an inlet 288 and an outlet 290. An inlet valve 292 is provided inside a receptacle 296 adjacent the inlet 288 and the tubing 238, and an outlet valve 294 is provided inside a receptacle 298 adjacent the outlet 290 and the tubing 240.

When the pump 232 is in the non-use position shown in FIG. 11, the withdrawal of the piston 234 in the direction of arrow FF creates a vacuum that draws water 236 into the chamber 280. This occurs because the vacuum draws the inlet valve 292 upwardly, to allow water 236 to flow around the inlet valve 292 to enter the chamber 280. The vacuum also pulls the outlet valve 294 down to be seated over the outlet 290 to prevent water 236 from exiting the chamber 280. When the piston 234 is depressed in the direction of arrow RR, the piston 234 compresses the spring 282, creating a pressure that pushes the inlet valve 292 downwardly in receptacle 296 to block water flow into the chamber 280. The pressure also pushes the water inside the chamber 280 out of the outlet 290, displacing the outlet valve 294 from the outlet 290, and causing the water to be delivered via the tubing 240 to the nozzle 218 for ejection. When the trigger 216 is released again, the spring load from the spring 282 will bias the piston 234 back in the forward direction of arrow FF, creating the vacuum to draw water into the chamber 280 again. Although FIGS. 11 and 12 illustrate one possible embodiment for the pump 232, it is possible to use any available pump.

The operation of the assembly 200 is illustrated in connection with FIGS. 9 and 10. FIG. 9 illustrates the assembly 200 in the stationary (non-use) position. First, the bubble producing device 208 is dipped into a bubble solution so that the wands 212 and 214 are completely immersed therein. The bubble solution can be held in a dish, and any conventional bubble solution can be used.

With bubble solution now extending in the form of a film across the openings of the wands 212, 214, the user actuates the assembly 200 by pressing the trigger 216. Referring to FIG. 10, pressing the trigger 216 will cause the trigger 216 to move rearwardly in the direction of arrow RR, causing the bottom of the V-shaped contact 262 to slide up the ramped edge 266 and to slide along the top surface 272 of the block 264. As the V-shaped contact 262 slides forwardly along the top surface 272, one of its top points will contact or couple the first electrical contact 258, thereby closing the circuit between the power source 250 and the motor 252, which will actuate the motor 252. Actuation of the motor 252 will cause the fan 210 to rotate, thereby creating a stream of air that will be directed at the films of bubble solutions extending across the wands 212, 214 to create a plurality of bubbles 220.

Simultaneous with the actuation of the motor 252 to generate bubbles 220, the rearward motion of the trigger 216 in the direction of arrow RR also causes water 236 to be drawn from the reservoir 230 via the tubing 238 and pumped via tubing 240 out of the nozzle 218 to create a jet of water 276 (see FIG. 7), as described in connection with FIGS. 11 and 12 above. The jets of water 276 can be used to fire or hit the generated bubbles 220.

After the trigger 216 is released, the spring 282 pushes the piston 234 (and its trigger 216) forwardly in the direction of arrow FF, to return to the non-use position shown in FIGS. 9 and 11. As the trigger 216 slides forwardly, the V-shaped contact 262 slides along the top surface 272 and off the ramped edge 266, causing the contacts 258 and 262 to disengage, thereby cutting power to the motor 252 and turning off the motor 252.

Thus, the embodiment illustrated in FIGS. 7–12 simultaneously performs two functions when actuated: (1) to actuate the fan 210 to generate bubbles 220, and (2) to eject a stream of water 276. The simultaneous performance of these two functions allows the user to generate bubbles 220 and shoot water at these bubbles 220 by simply actuating a trigger 216. In addition, the mere release of the trigger 216 will allow the assembly 200 to re-position itself to the non-use position where it is immediately ready for further bubble-shooting action. As a result, the use and operation of the assembly 200 is fast and simple.

Thus, the bubble generating assemblies 20 and 200 according to the present invention are easy to use, and combine multiple functions with a single actuation, thereby increasing the amusement value and play variety for the user.

While the description above refers to particular embodiments of the present invention, it will be understood that many modifications may be made without departing from the spirit thereof. The accompanying claims are intended to cover such modifications as would fall within the true scope and spirit of the present invention. As a non-limiting example, the blower 54 in the assembly 20 can be omitted and a fan similar to fan 210 can be used in its place. Similarly, the power source 250 can be omitted and mechanical means provided for actuating the fan 210. In addition, the pump 232 can be replaced by a pressurized water gun, where the gun is pumped to pressurize it, and then a trigger pressed to release the water.

What is claimed is:

1. A bubble generating assembly, comprising:

an air generator;

a bubble producing device positioned in front of the air generator to receive air generated from the air generator;

a liquid generator;

a nozzle spaced apart from the bubble producing device and coupled to the liquid generator for ejecting a stream of liquid in a direction other than below the bubble generating assembly; and an actuator operatively coupled to the liquid generator and the air generator for simultaneously actuating the liquid generator and the air generator.

2. The assembly of claim 1, wherein the liquid generator includes:

a reservoir for retaining a liquid; and a pump coupled to the reservoir for drawing liquid from the reservoir, the pump also coupled to the nozzle.

3. A bubble generating assembly, comprising:

an air generator;

a bubble producing device positioned in front of the air generator to receive air generated from the air generator, wherein the bubble producing device has a plurality of loops, each loop defining an interior opening;

a liquid generator;

a nozzle spaced apart from the bubble producing device and coupled to the liquid generator for ejecting a stream of liquid; and an actuator operatively coupled to the liquid generator and the air generator for simultaneously actuating the liquid generator and the air generator.

4. The assembly of claim 1, further including a power source operatively coupled to the air generator and the actuator.

5. The assembly of claim 4, further including a first contact coupling the actuator and the air generator, and a second contact coupling the power source and the actuator, and wherein the first and second contacts are coupled to actuate the air generator.

6. The assembly of claim 1, wherein the actuator is a trigger.

7. The assembly of claim 2, further including a housing for housing the reservoir and the pump, and wherein the housing has an opening for fluid communication with the reservoir.

8. The assembly of claim 2, further including a first tubing coupled to the pump for drawing liquid, and a second tubing coupling the pump and the nozzle.

9. A method of deploying a bubble generating assembly, the assembly having a wand for holding a film of bubble solution, the method including the step of simultaneously (i) actuating an air generator to blow air at the wand, and (ii) ejecting the liquid from a nozzle that is spaced apart from the wand, with the liquid ejected in a direction other than below the bubble generating assembly.

10. The method of claim 9, wherein the assembly further includes a reservoir for storing liquid, and wherein ejecting the liquid from the assembly includes actuating a liquid generator to eject liquid from the reservoir.

11. A bubble generating assembly, comprising:

an air generator;

a plurality of bubble producing wands;

a link having a first end coupled to the bubble producing wands; and an actuator operatively coupled to the link assembly and the air generator for simultaneously actuating the air generator and causing the link to position all the wands simultaneously in front of the air generator to receive air generated from the air generator.

12. The assembly of claim 11, further including a gear system operatively coupling the first end of the link and the plurality of wands.

13. The assembly of claim 12, wherein the gear system has a first gear that is coupled to one wand, and a second gear engaging the first gear and that is coupled to another wand.

14. The assembly of claim 11, wherein the plurality of wands includes two parallel side wands, and a front wand that is positioned perpendicular to the side wands, to generate three separate streams of bubbles.

15. The assembly of claim 11, further including a housing for housing the air generator and the link assembly, and a solution container coupled and external to the housing, with the plurality of wands retained inside the solution container when the assembly is in a non-use position.

16. The assembly of claim 15, wherein the link has a second end that is pivotally coupled to a cam block, and wherein the actuator engages the cam block to push the link forward when the actuator is pulled rearwardly.

17. The assembly of claim 16, wherein the forward motion of the link causes the gear system to raise the plurality of wands.

18. The assembly of claim 17, further including a spring coupled to the second end of the link for biasing the link rearwardly when the actuator is released.

19. The assembly of claim 12, wherein the first end of the link has a plurality of teeth for engaging the gear system.

20. A method of generating a plurality of streams of bubbles, including the step of simultaneously (i) positioning a plurality of wands simultaneously in front of an air generator, at separate orientations, and (ii) actuating the air generator to cause the air generator to direct air at the plurality of wands.

21. A bubble generating assembly, comprising:

an air generator;

a plurality of bubble producing wands;

a link having a first end coupled to the bubble producing wands; and an actuator operatively coupled to the link assembly and the air generator for simultaneously actuating the air generator and causing the link to position all the wands in front of the air generator to receive air generated from the air generator, wherein the plurality of wands includes two parallel side wands, and a front wand that is positioned perpendicular to the side wands, to generate three separate streams of bubbles.

* * * * *